US011562728B2

(12) United States Patent
Lee et al.

(10) Patent No.: US 11,562,728 B2
(45) Date of Patent: Jan. 24, 2023

(54) SHAPED ACOUSTIC ABSORBER

(71) Applicant: Toyota Motor Engineering & Manufacturing North America, Inc., Plano, TX (US)

(72) Inventors: Taehwa Lee, Ann Arbor, MI (US); Hideo Iizuka, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 362 days.

(21) Appl. No.: 16/822,566

(22) Filed: Mar. 18, 2020

(65) Prior Publication Data

US 2021/0295814 A1 Sep. 23, 2021

(51) Int. Cl.
*E04B 1/82* (2006.01)
*G10K 11/172* (2006.01)
*G10K 11/162* (2006.01)

(52) U.S. Cl.
CPC ..... *G10K 11/172* (2013.01); *G10K 11/162* (2013.01); *G10K 2210/118* (2013.01)

(58) Field of Classification Search
CPC ..... G10K 11/172; G10K 11/162; G10K 2210/118
USPC ..... 181/284, 286
See application file for complete search history.

(56) References Cited

U.S. PATENT DOCUMENTS 9,099,074 B1 * 8/2015 Lucon ..... E04B 1/84
10,119,589 B2 11/2018 Schaedler et al.
2019/0172437 A1 * 6/2019 Zalewski ..... G10K 11/172
2019/0295519 A1 * 9/2019 Krass ..... G02B 6/0051
(Continued)

FOREIGN PATENT DOCUMENTS

CN 101645263 B 5/2011
WO 1999010608 A1 3/1999

OTHER PUBLICATIONS

Simon, "Long Elastic Open Neck Acoustic Resonator for Low Frequency Absorption," Journal of Sound and Vibration, Elsevier, 2018, 421, 26 pages.

(Continued)

*Primary Examiner* — Ammar T Hamid
(74) *Attorney, Agent, or Firm* — Christopher G. Darrow; Darrow Mustafa PC

(57) ABSTRACT

A shaped acoustic absorber assembly is provided with broadband absorption. The assembly includes an acoustic panel defining a plurality of apertures, and a plurality of tubular quarter-wavelength resonators of variable lengths provided respectively aligned with the plurality of apertures and coupled to the acoustic panel. Each tubular quarter-wavelength resonator includes at least one perimeter boundary wall extending in a longitudinal length direction and defining a chamber cavity having a chamber volume. A first end defines an opening aligned with one of the plurality of apertures and coupled to the acoustic panel. A second end is provided opposite the first end, and is sealed and configured for being located adjacent a target substrate. Methods are provided for shaping the tubular quarter-wavelength resonators to coordinate with a geometry and dimensions of a target substrate and then preserving a shape of the tubular quarter-wavelength resonators in a structurally rigid configuration.

20 Claims, 9 Drawing Sheets

(56) References Cited

U.S. PATENT DOCUMENTS

| | | | | |
|---|---|---|---|---|
| 2021/0039361 | A1* | 2/2021 | Koshitouge | E04B 1/86 |
| 2021/0256948 | A1* | 8/2021 | Tomimatsu | G10K 11/172 |

OTHER PUBLICATIONS

Jimenez et al., "Rainbow-trapping absorbers: Broadband, perfect and asymmetric sound absorption by subwavelength panels for transmission problems," Scientific Reports 7, 13595, 2017, pp. 1-12.

Yang et al., "Optimal Sound-Absorbing Structures," Material Horizon, 2017, including supplementary information, 22 pages.

Zhu et al., "Broadband ultra-thin acoustic metasurface absorber," Applied Physics, arXiv: 1906.11500v1 [physics.app-ph], Jun. 2019, 12 pages.

* cited by examiner

SHAPED ACOUSTIC ABSORBER

TECHNICAL FIELD

The present disclosure generally relates to acoustic metamaterials and, more particularly, to improved and custom shaped acoustic absorbers with broadband applications.

BACKGROUND

The background description provided herein is for the purpose of generally presenting the context of the disclosure. Work of the presently named inventors, to the extent it may be described in this background section, as well as aspects of the description that may not otherwise qualify as prior art at the time of filing, are neither expressly nor impliedly admitted as prior art against the present technology.

Current broadband acoustic absorbers are almost exclusively provided in the form of a panel, which needs to be compact. The conventional approach of designing a compact broadband absorber is based on using multiple resonators having different physical dimensions. A complexity in the fabrication of such absorbers arises because the resonators may need to be combined in such a way that some may be straight and some may be shaped or bended in order to accommodate the different size of resonators that are needed in a given small space. Each different method of constructing an acoustic absorber with multiple resonators may require custom needs. In additions, problems may arise during installation, when acoustic absorbers need to be installed surrounding structures that may be of arbitrary shapes. While some resonators are available with different lengths and physical dimensions, they are not allowed to bend or be re-shaped after fabrication.

Accordingly, it would be desirable to provide an improved acoustic system having the ability to be shaped for applications requiring a non-planar absorbing panel, as well as for use with a broad frequency absorption range.

SUMMARY

This section provides a general summary of the disclosure, and is not a comprehensive disclosure of its full scope or all of its features.

In various aspects, the present teachings provide a shaped acoustic absorber assembly with broadband absorption. The shaped acoustic absorber assembly includes an acoustic panel defining a plurality of apertures. A plurality of tubular quarter-wavelength resonators of variable lengths are provided respectively aligned with the plurality of apertures and coupled to the acoustic panel. Each tubular quarter-wavelength resonator includes at least one perimeter boundary wall extending in a longitudinal length direction and defining a chamber cavity having a chamber volume. Each tubular quarter-wavelength resonator has a first end defining an opening aligned with one of the plurality of apertures and coupled to the acoustic panel. The opening is configured to provide fluid communication between the chamber cavity and an external environment. A second end is provided opposite the first end. The second end is sealed and configured for being located adjacent a target substrate. The plurality of tubular quarter-wavelength resonators are shaped to coordinate with a geometry and dimensions of the target substrate.

In other aspects, the present teachings provide a shaped acoustic absorber system with broadband absorption. The shaped acoustic absorber system includes a target substrate and a plurality of acoustic panels arranged in a periodic array. Each acoustic panel includes a plurality of tubular quarter-wavelength resonators of variable lengths coupled to a plurality of apertures defined in a surface of the acoustic panel. Each tubular quarter-wavelength resonator includes at least one perimeter boundary wall extending in a longitudinal length direction and defining a chamber cavity having a chamber volume. The perimeter boundary wall includes a flexible material configured to be shaped to coordinate with a geometry and dimensions of the target substrate and subsequently be preserved in a structurally rigid configuration. Each tubular quarter-wavelength resonator includes a first end defining an opening aligned with one of the plurality of apertures and coupled to the acoustic panel. The opening is configured to provide fluid communication between the chamber cavity and an external environment. Each tubular quarter-wavelength resonator further includes a second end located opposite the first end. An end cap is disposed in the second end and cooperates with the perimeter boundary wall to define the chamber cavity.

In still other aspects, the present teachings provide a method for making a shaped acoustic absorber assembly with broadband absorption. The method includes providing an acoustic panel with a plurality of flexible tubular quarter-wavelength resonators of variable lengths coupled adjacent to a plurality of apertures defined in the acoustic panel. Each quarter-wavelength resonator includes at least one perimeter boundary wall extending in a longitudinal length direction and defining a chamber cavity having a chamber volume. A first end defines an opening aligned with one of the plurality of apertures and coupled to the acoustic panel. The opening is configured to provide fluid communication between the chamber cavity and an external environment. A second end is provided, opposite the first end, and is sealed and configured for being located adjacent a target substrate. The method includes shaping the plurality of flexible tubular quarter-wavelength resonators to coordinate with a geometry and dimensions of a target substrate intended to be located in proximity with the acoustic panel. The method also includes preserving a shape of the flexible tubular quarter-wavelength resonators in a structurally rigid configuration. In various aspects, methods of preserving the shape of the flexible tubes can include: mechanically fastening a plurality of flexible tubular quarter-wavelength resonators to one another; providing the flexible tubular quarter-wavelength resonators with a curable composition or coating, and curing the composition or coating while in a desired shape; filling a free space between the flexible tubular quarter-wavelength resonators with a curable liquid solution, and curing the liquid solution; arranging the flexible tubular quarter-wavelength resonators adjacent to one another and forming a densely packed arrangement; and applying a spray coating to at least a portion of the flexible tubular quarter-wavelength resonators using a thermal spraying technique.

Further areas of applicability and various methods of enhancing the disclosed technology will become apparent from the description provided herein. The description and specific examples in this summary are intended for purposes of illustration only and are not intended to limit the scope of the present disclosure.

BRIEF DESCRIPTION OF THE DRAWINGS

The present teachings will become more fully understood from the detailed description and the accompanying drawings, wherein.

It should be noted that the figures set forth herein are intended to exemplify the general characteristics of the methods, algorithms, and devices among those of the present technology, for the purpose of the description of certain aspects. These figures may not precisely reflect the characteristics of any given aspect, and are not necessarily intended to define or limit specific embodiments within the scope of this technology. Further, certain aspects may incorporate features from a combination of figures.

DETAILED DESCRIPTION

The present technology generally provides a shaped acoustic absorber assembly with broadband absorption capabilities. The assembly includes an acoustic panel defining a plurality of apertures, and a plurality of tubular quarter-wavelength resonators of variable lengths. The tubular quarter-wavelength resonators are aligned with the respective plurality of apertures and are coupled to the acoustic panel. Each tubular quarter-wavelength resonator includes at least one perimeter boundary wall extending in a longitudinal length direction and defining a chamber cavity having a chamber volume. A first end defines an opening aligned with one of the plurality of apertures and coupled to the acoustic panel. A second end is provided, opposite the first end, and is sealed and configured for being located adjacent a target substrate. Methods are provided for shaping the tubular quarter-wavelength resonators to coordinate with a geometry and dimensions of a target substrate and then preserving a shape of the tubular quarter-wavelength resonators in a structurally rigid configuration.

Figure 1:
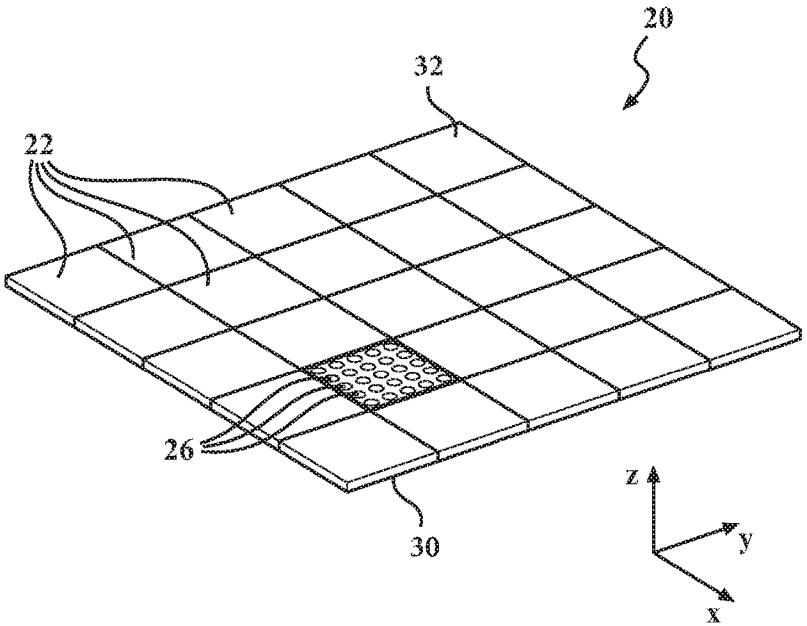
FIG. 1 is a top perspective view of a sizable acoustic absorber assembly design including an array of acoustic panels.

FIG. 1 is a top perspective view of an exemplary design of a sizable acoustic absorber assembly 20 including a plurality of acoustic panels 22 that are shown aligned and arranged in a periodic array. While the periodic array design of acoustic panels 22 is generally illustrated as being substantially planar and having square shape, it should be understood that the periodic array can be arranged in any number of shapes, and is not limited to a planar orientation. For example, in various aspects, the acoustic absorber assembly 20 may be used in automotive related applications where it is desirable to locate the acoustic absorber assembly 20 adjacent to a shaped component. Accordingly, the acoustic absorber assembly 20 can be designed having a shape to coordinate with, or substantially match a geometry and dimensions of the shaped component.

Figure 2:
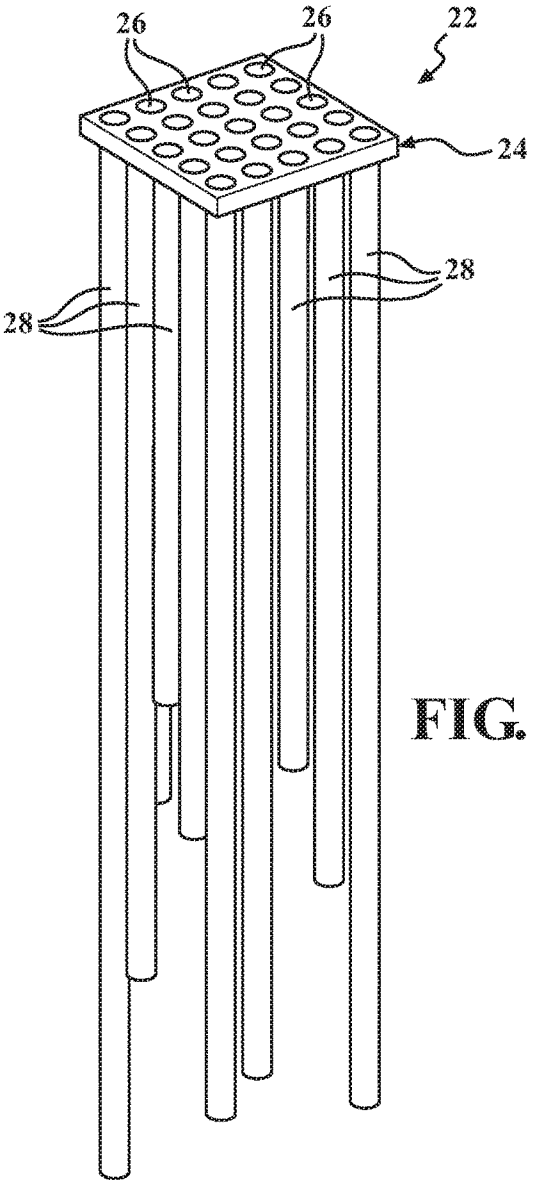
FIG. 2 is a perspective view of an exemplary acoustic panel of the acoustic absorber assembly as provided FIG. 1, and further illustrating a plurality of tubular resonators in a non-shaped orientation, having variable lengths.

FIG. 2 is a perspective view of an exemplary acoustic panel 22 of the acoustic absorber assembly 20 as provided FIG. 1, and further illustrating a plurality of tubular resonators 28 having variable lengths extending there from in a non-shaped orientation. The structures of the tubular resonators 28 of the present technology have a unique applicability in various applications that benefit from having a compact, small size and for low frequency use.

In the non-limiting example as shown in FIG. 2, the acoustic panel 24, also referred to as an acoustic plate, is provided including an acoustic substrate 25 and a periodic array of apertures 26 defined within the acoustic substrate 25. In various aspects, the apertures 26 may be custom formed in the acoustic substrate 25. In other aspects, the acoustic panel 24 can be provided as what may be referred to as a preformed perforated plate. With regard to the overall design of the acoustic absorber assembly 20, as noted above, while the acoustic panel 24 is shown as a square-shaped, planar panel, it should be understood that the shape and size of each acoustic panel 24 can vary based on the desired end use.

With particular reference to FIGS. 1-2, the apertures 26 can also be periodic in 2-dimensions (e.g. the x, y dimensions of FIGS. 1-2). In this exemplary arrangement, the periodic array of tubular quarter-wavelength resonators 28 shown in FIG. 2 has periodicity in both x and y dimensions. This can be termed a two-dimensional array. The period, P, of the periodic array of tubular quarter-wavelength resonators 28 (best shown in FIG. 5) may generally be substantially smaller than the wavelength of the acoustic waves that the acoustic structure is designed to absorb. In various designs, the center to center periodic distance, P, between each tubular quarter-wavelength resonator 28 may be the same for the plurality of resonators in each acoustic panel 22.

Figure 3:
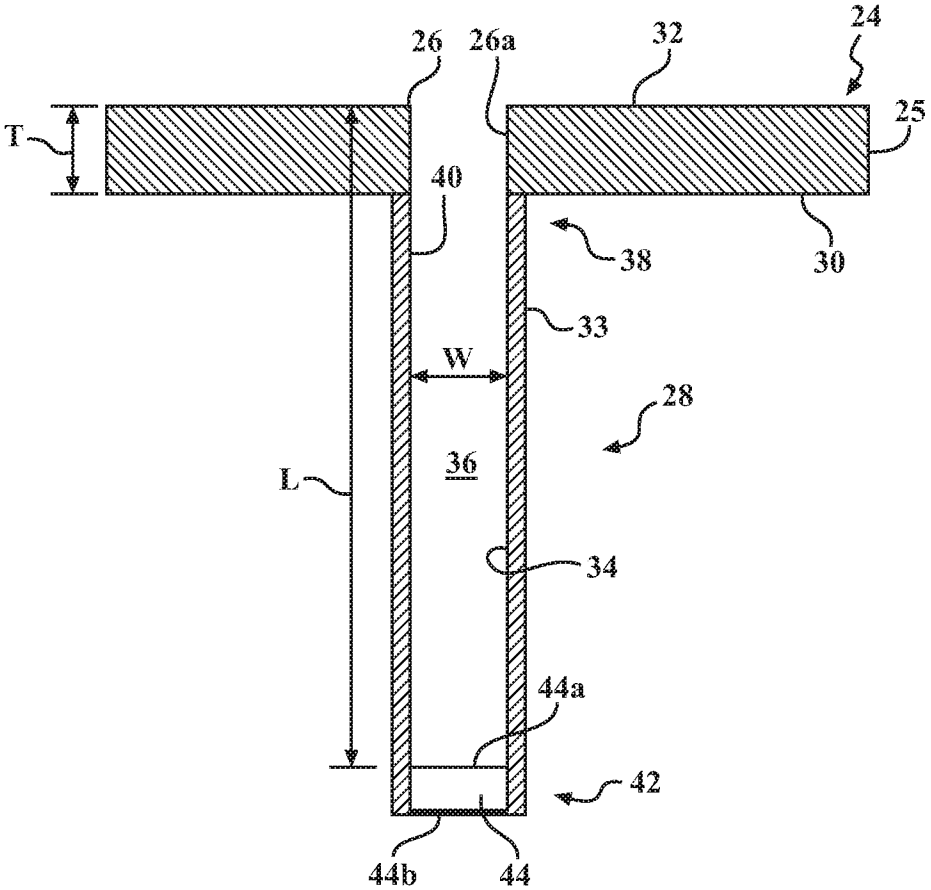
FIG. 3 is a schematic view of an acoustic panel with a single tubular quarter-wavelength resonator, shown in an initial non-shaped position.

In certain aspects, the acoustic substrate 25 of the acoustic panel 22 may include a flexible material, providing a flexible substrate. Such a flexible substrate may be used to provide a flexible structure over the course of its entire use. In other aspects, as will be described in more detail below, such a structure may have an initial degree of flexibility that is later transformed into a more rigid structure through a curing or hardening method after being shaped and/or conformed to coordinate with or match a shape of a target substrate, or the like. In still other aspects, the acoustic substrate 25 may initially include a rigid or structurally solid material, providing a rigid substrate at all times. For example, in various aspects, at least a portion of the acoustic substrate 25 can be made of what is referred to as an acoustically solid or hard material, such as metal, glass, wood, plastic, a thermoplastic resin, such as polyurethane, a ceramic, or any other suitable material. As shown in FIGS. 1 and 3, the acoustic substrate 25 has first and second opposing major surfaces 30, 32. The upwardly facing major surface 32 is generally exposed to an external environment. The plurality of apertures 26 defined in the acoustic substrate 25 are intended to be aligned with the tubular quarter-wavelength resonators 28. The tubular quarter-wavelength resonators 28 can be coupled to the acoustic substrate 25 using various mechanical and adhesive fastening techniques as is known in the art.

FIG. 3 is a schematic view of an acoustic panel 22 with a single tubular quarter-wavelength resonator 28, shown in an initial non-shaped position, coupled to the acoustic panel 24. The tubular quarter-wavelength resonator 28 includes at least one perimeter boundary wall 33 that generally extends in a longitudinal length direction. The perimeter boundary wall 33 may be one component, or a number of walls or portions coupled together to form the tubular quarter-wavelength resonator 28. Generally, the perimeter boundary wall 33 defines a chamber cavity 36 having a chamber volume. Each tubular quarter-wavelength resonator 28 may be a hollow tube or tubular member that is independently coupled to the acoustic panel 22. As shown, the tubular quarter-wavelength resonator 28 has a first end 38 and an opposite second end 42. The first end 38 defines an opening 40 that is aligned with one of the plurality of apertures 26, and is configured to provide fluid communication between the chamber cavity 36 and external environment. The cross-sectional shape of the perimeter boundary wall 33 may vary based on the overall shape and configuration of the tubular quarter-wavelength resonator(s) 28. In various aspects, the cross-sectional shape may be substantially uniform in the longitudinal direction and provided as a circle, a triangle, a rectangle, and combinations of resonators having different shapes. Shapes other than those specifically mentioned herein may also be useful, depending on the ultimate design and end use. The second end 42 of the tubular quarter-wavelength resonator 28 may be provided as a sealed end, and configured to be located adjacent to a target substrate. In various aspects, the sealed end 42 may be an extension of the material of the perimeter boundary wall 33, or a material that is coupled, joined, or is otherwise fixed to the perimeter boundary wall 33, which then cooperates to define the chamber cavity 36. In other aspects as shown in FIG. 3, an end cap 44 may be disposed within the second end 42 of the tubular quarter-wavelength resonator 28, and the end cap 44 cooperates with the perimeter boundary wall 33 to define the chamber cavity 36. The use of an end cap 44 allows one to cut the tubular quarter-wavelength resonators 28 to a specific size. As shown, the end cap 44 is non-porous and has an inner surface 44*a* and an outer surface 44*b*. The outer surface 44*b* may be in flush alignment with the second end 42. While the end cap 44 can be made of various materials, the end cap 44 should be a structurally rigid material and provided having appropriate dimensions in order to be configured to provide a seal for second end 42 of the tubular quarter-wavelength resonator 28.

Figure 4:
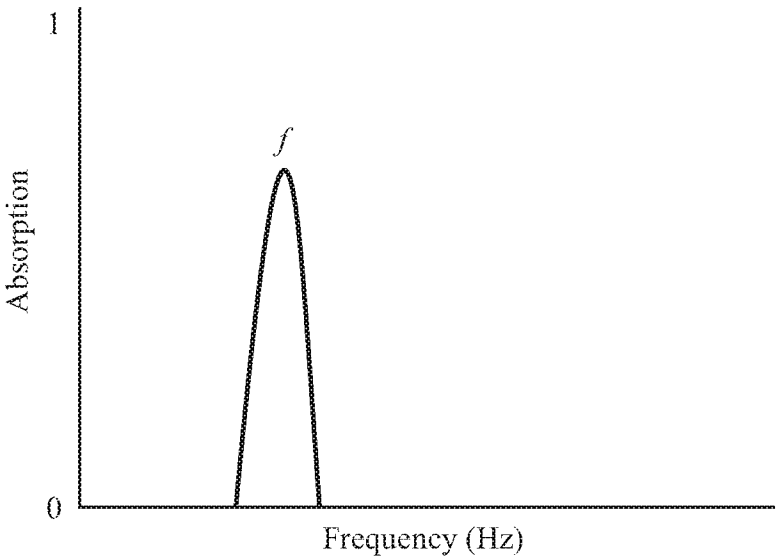
FIG. 4 is an exemplary plot showing one representation of the absorption for the frequency of the single tubular quarter-wavelength resonator of FIG. 3, when the resonator is subsequently shaped and in a structurally rigid configuration.

In various aspects, the tubular quarter-wavelength resonators 28 can be coupled to the lower facing major surface 30 of the acoustic substrate 25, and the inner wall 34 of each tubular quarter-wavelength resonator 28 can be aligned with the inner wall 26*a* of each aperture 26. In this configuration as shown in FIG. 3, a length dimension, L, of the tubular quarter-wavelength resonator 28 begins at the upwardly facing major surface 32 and ends at the inner surface 44*a* of the end cap 44. In other words, the length dimension, L, includes a thickness dimension, T, of the acoustic substrate 25. Preferably, the inner width, W, of the chamber cavity 36 is equal to a width of the aperture 26. With the design as shown in FIG. 3, each tubular quarter-wavelength resonator exhibits a resonance frequency, f, according to the relationship provided in Equation 1:

$$f = \frac{c}{4L} \qquad \text{(Equation 1)}$$

where c is the speed of sound of fluid in the chamber cavity, and L is a length dimension of the tubular quarter-wavelength resonator. FIG. 4 is an exemplary plot showing one representation of the absorption (ranging between zero and one) for the frequency f of the single tubular quarter-wavelength resonator 28 of FIG. 3, when the resonator is subsequently shaped and preserved in a structurally rigid configuration.

Figure 5:
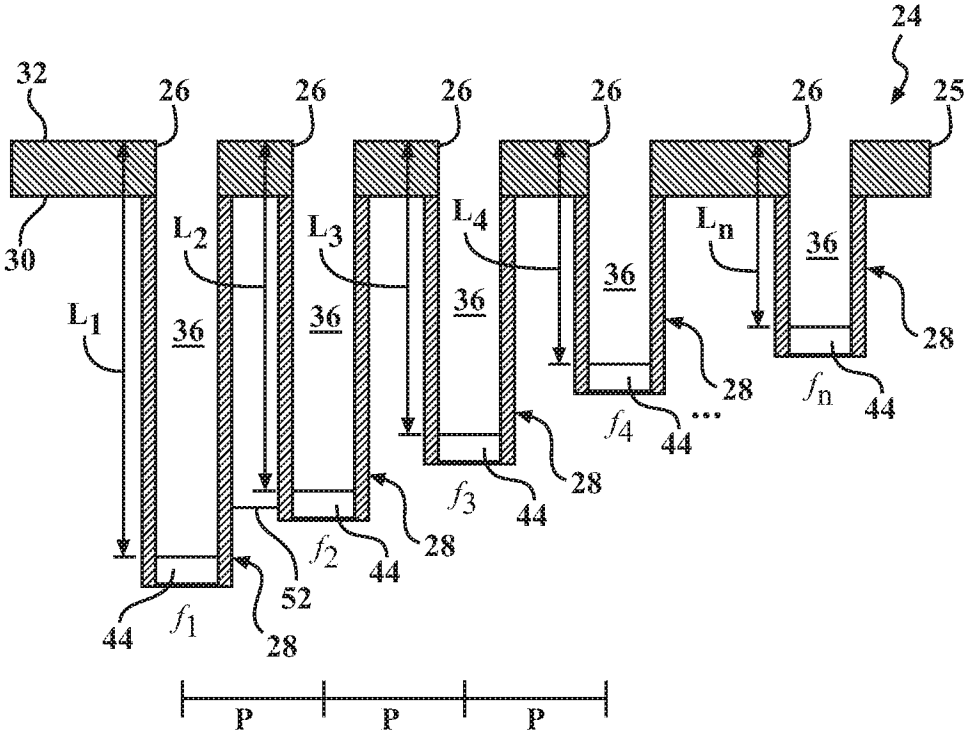
FIG. 5 is a schematic view of an acoustic panel with a plurality of tubular quarter-wavelength resonators, shown in an initial non-shaped position, where each resonator may have a different resonance frequency.

Broadband absorption can be realized by combining resonators of different resonance frequencies. FIG. 5 is a schematic view of an acoustic panel with a plurality of tubular quarter-wavelength resonators 28, shown in an initial non-shaped position, where each tubular quarter-wavelength resonator 28 may have a different length, thus a different resonance frequency ($f_1$, $f_2$, $f_3$, $f_4$, . . . , $f_n$). The features of the tubular quarter-wavelength resonators 28 of FIG. 5 are the same as discussed above with respect to FIG. 3. As shown for illustrative purposes only, the series of tubular quarter-wavelength resonators 28 of FIG. 5 are aligned in order of decreasing length dimensions ($L_1$, $L_2$, $L_3$, $L_4$, . . . , $L_n$). The actual arrangement by length may vary based on the design. For example, FIG. 2 illustrates a plurality of tubular quarter-wavelength resonators 28 arranged having a mix of non-uniform lengths, with each having its own equivalent frequency. In various aspects, at least two of the plurality of tubular quarter-wavelength resonators 28 will generally be provided having different lengths and, thus, different resonance frequencies, f. While various design differences can lead to the different resonance frequencies, the present technology generally focuses on a change in the length dimension, L, that ultimately leads to a difference in the chamber volumes. Alternatively, a change in the volume may also be based on a width dimension, W, or change in diameter of the chamber cavity 36. Of course, with geometries other than a cylinder shaped cavity, other suitable dimensions may be varied.

Figure 6:
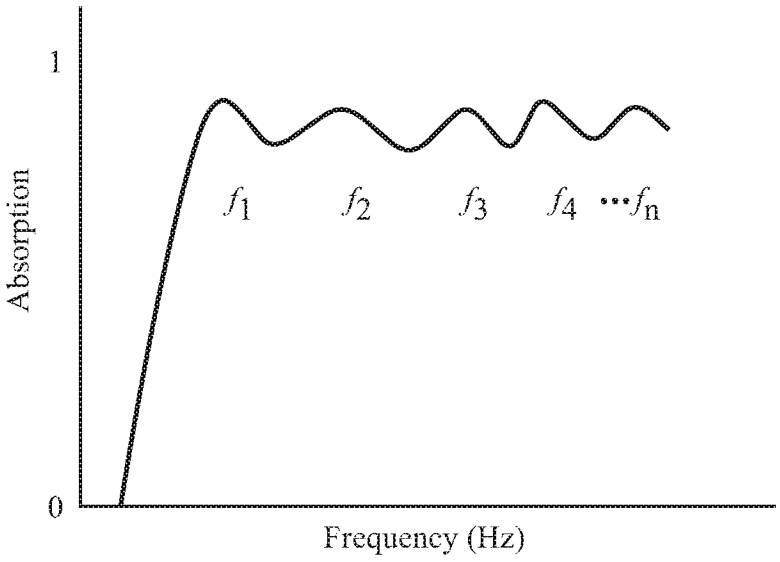
FIG. 6 is an exemplary plot showing one representation of the absorption for each frequency of the plurality of tubular quarter-wavelength resonators of FIG. 5, when the resonators are subsequently shaped and preserved in a structurally rigid configuration.

FIG. 6 is an exemplary plot showing one representation of the absorption for each frequency ($f_1$, $f_2$, $f_3$, $f_4$, . . . , $f_n$) of the plurality of tubular quarter-wavelength resonators of FIG. 5, when the resonators are subsequently shaped and preserved in a structurally rigid configuration.

Figure 7:
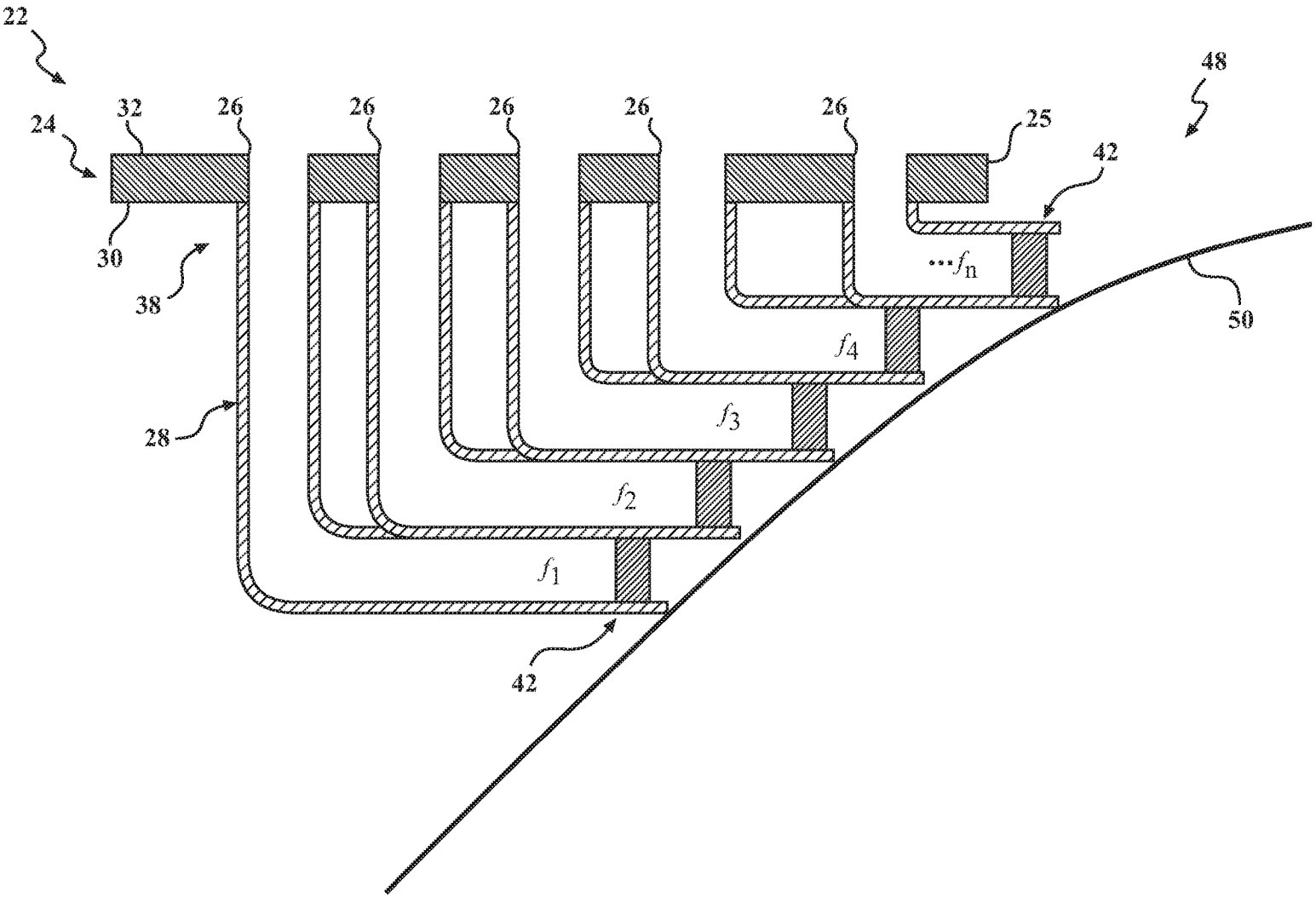
FIG. 7 is a schematic view of an acoustic absorber system including a plurality of tubular quarter-wavelength resonators, shown in a structurally rigid position and adjacent a target substrate, where each resonator has a different resonance frequency and is shaped to coordinate with a geometry and dimensions of the target substrate.

FIG. 7 is a schematic view of an acoustic absorber system 48 including an acoustic panel 22 having an acoustic plate 24 with a plurality of tubular quarter-wavelength resonators 28 coupled to the acoustic substrate 25 at the lower facing major surface 30 and in a structurally rigid position, aligned adjacent to an edge of a shaped target substrate 50. In FIG. 7, the tubular quarter-wavelength resonators 28 are shown having an exemplary curved shape, for example, each having one bend of about 90 degrees. It should be understood that this is only one arrangement, and the plurality of tubular quarter-wavelength resonators 28 may be provided having various complex shapes, turns, and bends in order to be aligned with the shaped target substrate 50. Each tubular quarter-wavelength resonator 28 is shown having a different resonance frequency ($f_1$, $f_2$, $f_3$, $f_4$, . . . , $f_n$), and each is shaped such that the respective second ends 42 are located at a position to coordinate with a geometry and dimensions of the target substrate 50.

In certain aspects, an optional lossy porous medium (not shown) may be provided adjacent the inner wall 26*a* of one or more aperture 26, functioning to dissipate acoustic energy into heat. The internal lossy porous medium is preferably a soft, porous material. In various aspects, the lossy porous medium can be secured within the aperture 26 with a tight press-fit against the inner wall 26*a*. In other aspects, the acoustic substrate 25 may include a shaped retention feature to secure the lossy porous medium. In some implementations, the lossy porous medium can have a porosity greater than 0.5, or 0.6, or 0.7, or 0.8, or 0.9. Non-limiting examples of materials useful as a lossy porous medium and suitable for use with the present technology include melamine and various polyurethane foams known in the art that are capable of dissipating acoustic energy to heat.

In various aspects, the present technology provides for the use of flexible tubular quarter-wavelength resonators 28 that are shaped to coordinate with a geometry and dimensions of a target substrate, and are then ultimately preserved having that shape. In certain examples, the perimeter boundary wall 33 may include a flexible material that permits flexing and shaping. In one aspect, at least two of the tubular quarter-wavelength resonators 28 can be arranged together to collectively form a shape that coordinates with a geometry and dimensions of a surface of the target substrate 50. With renewed reference to FIG. 5, the at least two of the tubular quarter-wavelength resonators 28 may be coupled to one another with a fastening mechanism 52 for either coordinated movement with one another, and/or to retain a certain shape. Exemplary fastening mechanisms 52 can include ties, cables, wires, cords, and the like that can couple multiple resonators together. Such mechanical fastening mechanisms can be incorporated before or after shaping.

Figure 8:
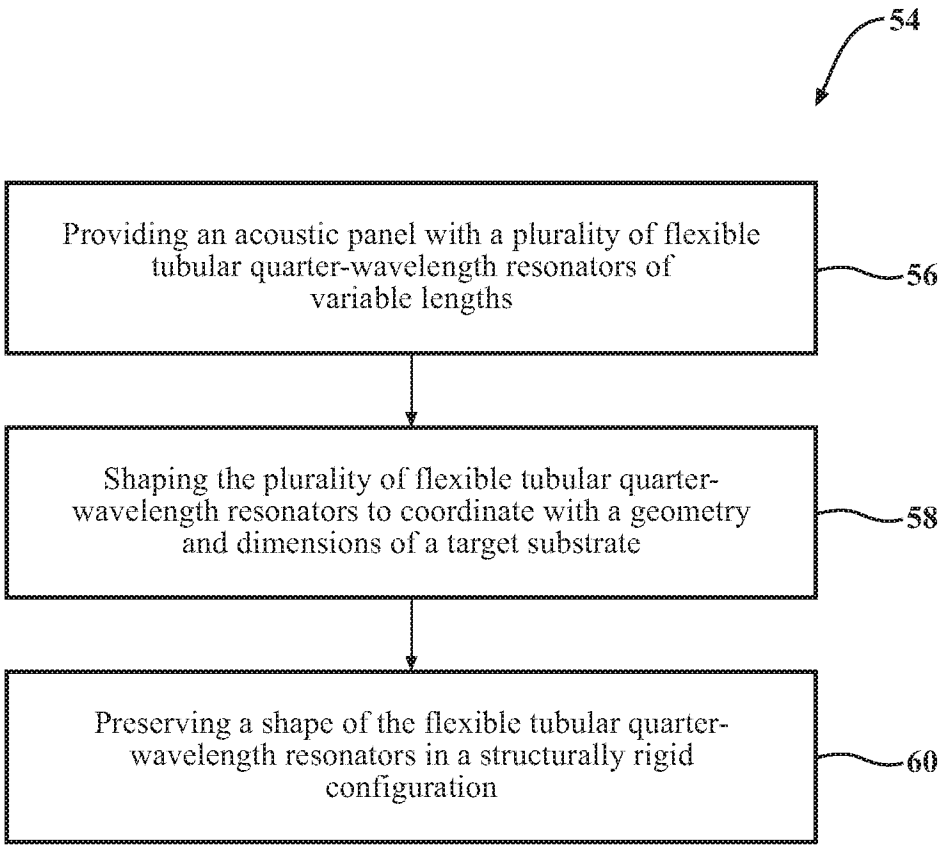
FIG. 8 is an exemplary flow diagram for methods of forming a shaped acoustic absorber assembly according to various aspects of the present technology.

In various other aspects, the flexible material of the perimeter boundary wall 33 may be provided with one or more components, such as a photoinitiator or catalyst that, after being shaped, can be used to make the perimeter boundary wall 33 rigid by a curing and/or hardening process. FIG. 8 is an exemplary flow diagram 54 illustrating various methods of forming a shaped acoustic absorber assembly according to various aspects of the present technology. As shown with respect to method box 56, the methods begin by providing an acoustic panel 22 with a plurality of flexible tubular quarter-wavelength resonators 28 of various lengths as described above. For example, each tubular quarter-wavelength resonator 28 may be provided with a flexible perimeter boundary wall 33. The methods include shaping and/or reshaping the plurality of flexible tubular quarter-wavelength resonators for space-limited applications. As shown with respect to method box 58, this shaping may include flexing and bending the tubular quarter-wavelength resonators such that the second ends 42 are ultimately coordinated to match with a geometry and dimensions of at least one surface of the target substrate. As shown with respect to method box 60, one shaped, the methods of the present technology include preserving a shape of the tubular quarter-wavelength resonators in a structurally rigid configuration.

Figure 9B:
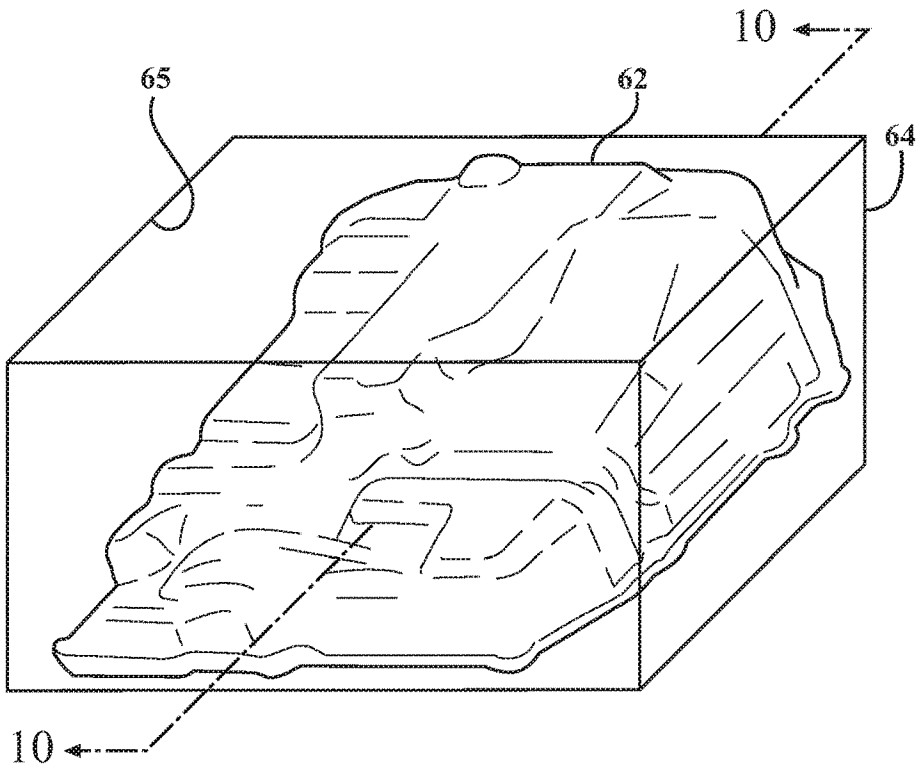
FIG. 9B illustrates a mold structure having an internal shape of the oil pan target substrate as provided in FIG. 9A.
Figure 9A:
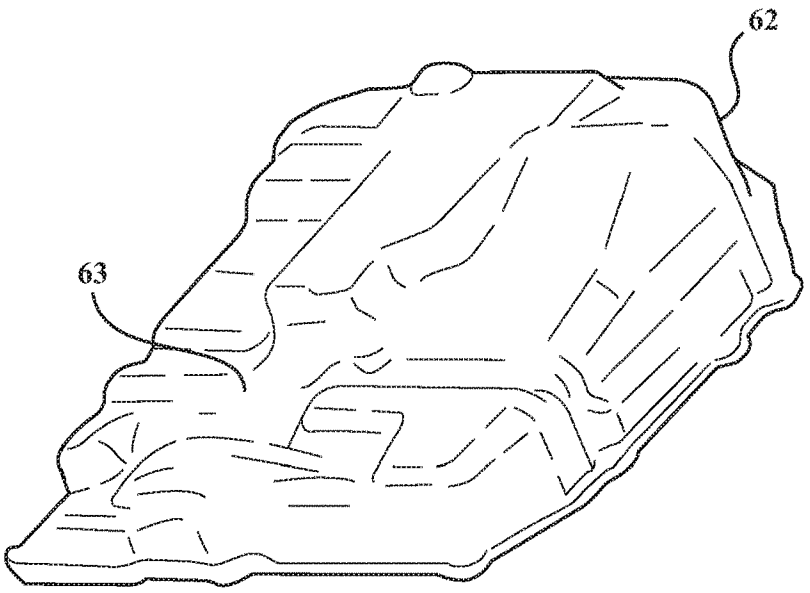
FIG. 9A is an exemplary target substrate, provided as an oil pan.
Figure 10B:
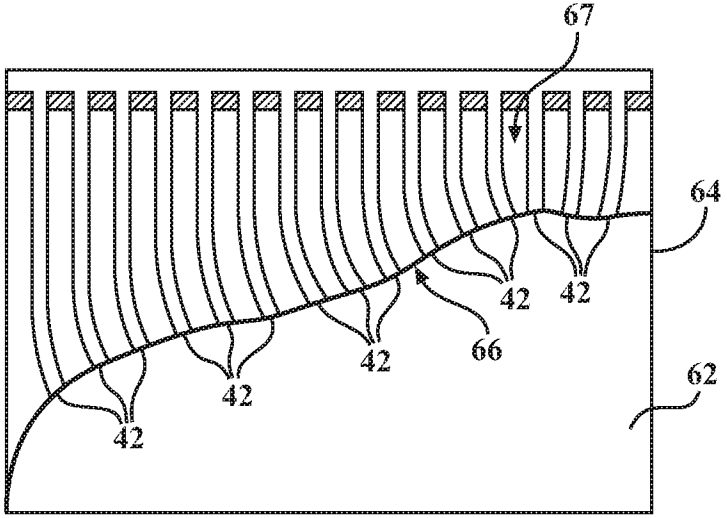
FIG. 10B illustrates the plurality of tubular quarter-wavelength resonators in the mold structure and shown in a shaped position.
Figure 11:
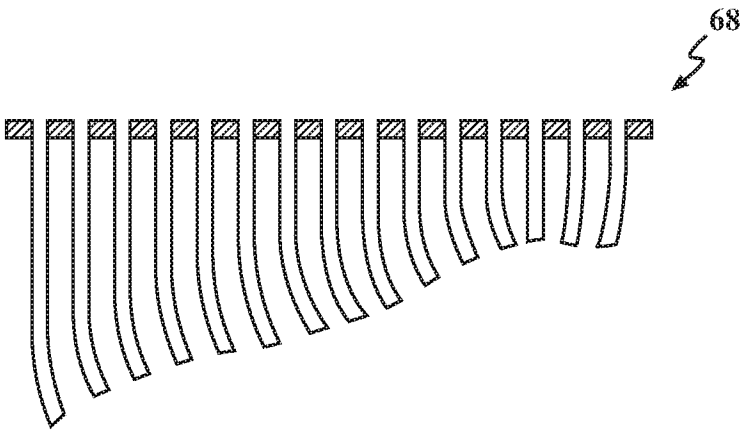
FIG. 11 is a schematic view of the acoustic panel of FIG. 10B with the plurality of tubular quarter-wavelength resonators shown in a structurally rigid position, where each resonator has a different resonance frequency and is shaped to coordinate with a geometry and dimensions of the target substrate.
Figure 10A:
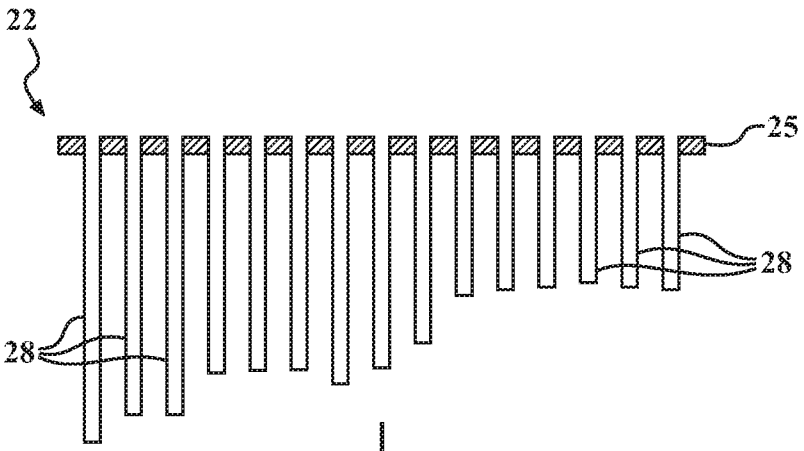
FIG. 10A is a schematic cross-sectional view of the mold of FIG. 9B taken along the line 10-10 of FIG. 9B, and further illustrating an acoustic panel having a plurality of tubular quarter-wavelength resonators, shown in an initial non-shaped position, being lowered into the mold of FIG. 9B.
Figure 10A:
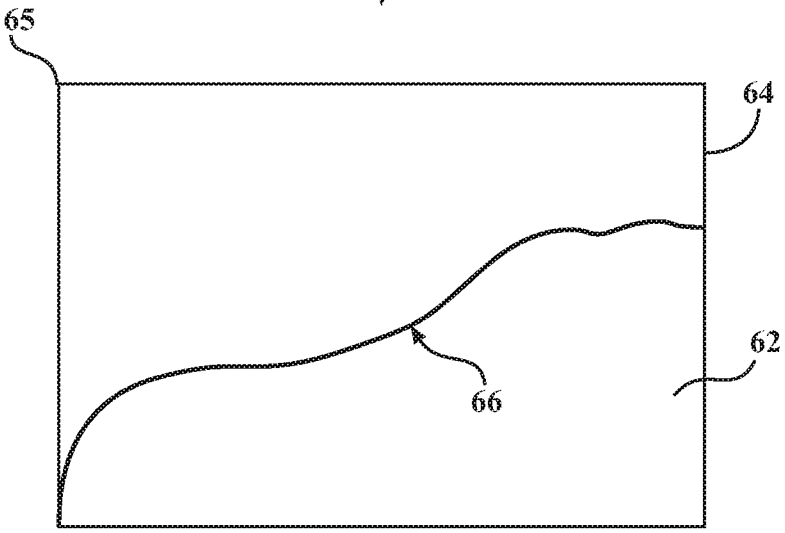

To further illustrate the present technology, the following example is provided with reference to FIGS. 9-11. FIG. 9A is an exemplary target substrate 62, provided as an oil pan cover. It should be understood that the target substrate can have any number of different shapes and sizes, and does not need to be automotive related. As shown, the target substrate 62 is shaped and has an outer surface 63 with various curves and contours. FIG. 9B illustrates an exemplary mold structure 64 that is provided having an internal shape of the oil pan target substrate as provided in FIG. 9A. For ease of illustration, the mold structure 64 may be provided with an open top 65, configured to accept an acoustic panel having a plurality of tubular quarter-wavelength resonators extending therefrom.

FIG. 10A is a partial animation view showing the insertion of an acoustic panel 22 having a plurality of flexible tubular quarter-wavelength resonators 28 of different lengths being lowered into the mold structure 64 of FIG. 9B. For example, the lower half of FIG. 10A is schematic cross-sectional of the mold structure 64 of FIG. 9B taken along the line 10-10 of FIG. 9B, and includes a contour 66 representative of a shape of the upper surface of the target substrate 62. In FIG. 10A, the plurality of tubular quarter-wavelength resonators 28 are shown in an initial non-shaped position. Each of the tubular quarter-wavelength resonators 28 may be provided with a perimeter boundary wall 33 including a material that is initially flexible, but includes at least one component that can be used to preserve the shaped material in a structurally rigid configuration after being shaped. In various non-limiting examples, the material may include at least one of an ultra-violet (UV) curable composition, a UV curable coating, a thermally curable composition, and a thermally curable coating. As is known in the art, UV curing is a process where ultraviolet light is used to initiate a photochemical reaction that generates a crosslinked network of polymers. Non-limiting examples of UV curable materials useful as additives or coatings with the present technology include the typical UV curable resins such as those including oligomers, monomers, photo-polymerization initiators, co-initiators, and various additives such as stabilizers, antioxidants, plasticizers, and pigments. Non-limiting examples of temperature curable materials useful as additives or coatings with the present technology may include epoxy resins, adhesives, and the like.

FIG. 10B illustrates the plurality of tubular quarter-wavelength resonators 28 arranged in the mold structure 64 and shown in a shaped position. For example, once pressed into the mold, the tubular quarter-wavelength resonators 28 are shown having a slightly curved shape, and the respective second ends 42 of the tubular quarter-wavelength resonators 28 are shown generally aligned with the contour 66 of the target substrate 62. In other words, they are arranged together to collectively form a shape that coordinates with a geometry and dimensions of at least one surface/contour 66 of the target substrate 62. There may be a range of different sized gaps 67, or free space, between adjacent tubular quarter-wavelength resonators 28, depending on the design and end use. In other aspects, the tubular quarter-wavelength resonators 28 may be arranged and shaped adjacent to one another in order to form a densely packet arrangement. Such a densely packed arrangement may provide an increased rigidity, for example, rely on a crowding effect, where the proximity of neighboring resonators influences the rigidity.

FIG. 11 is a schematic view of a resulting acoustic panel 68 created by the mold structure 64 of FIGS. 10A-B, with the plurality of tubular quarter-wavelength resonators 28 shown in a structurally rigid position, for example, after being cured into a desired shape. As illustrated with the different length dimensions, each tubular quarter-wavelength resonator 28 may have a different resonance frequency and is now shaped to coordinate with a geometry and dimensions of the target substrate.

In other aspects, methods of preserving the shapes of the flexible tubular quarter-wavelength resonators may include various spray coating techniques, as well as different curing techniques. With respect to spray coating, the methods may include applying a spray coating technique, or dip coating technique, to at least a portion of the flexible tubular quarter-wavelength resonators using a thermal spraying technique while the resonators are in a desired shape and configuration. Various thermal spraying techniques are widely known in the art. With renewed reference to FIG. 10B, in various aspects the free space 67 between the tubular quarter-wavelength resonators can be filled with a curable liquid solution, and the methods further include curing the liquid solution to preserve the shapes. As should be appreciated by those of ordinary skill in the art, these techniques are not meant to be limiting, and various other preservation and solidification techniques may be useful with the present technology.

Figure 12:
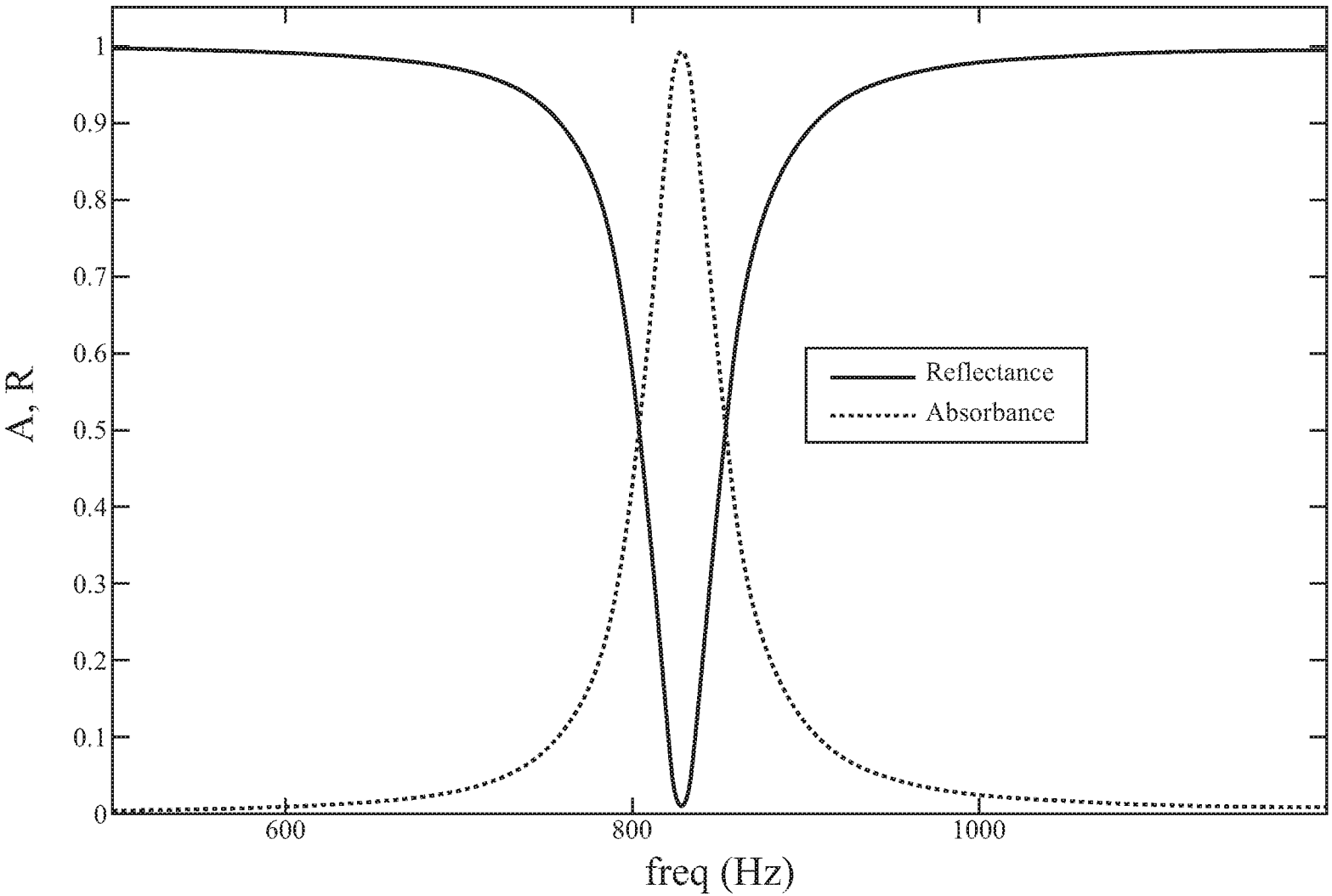
FIG. 12 is a simulated graph representing acoustic absorbance and reflection as a function of frequency for an acoustic panel with tubular quarter-wavelength resonators of the same length being periodically arranged.
Figure 13:
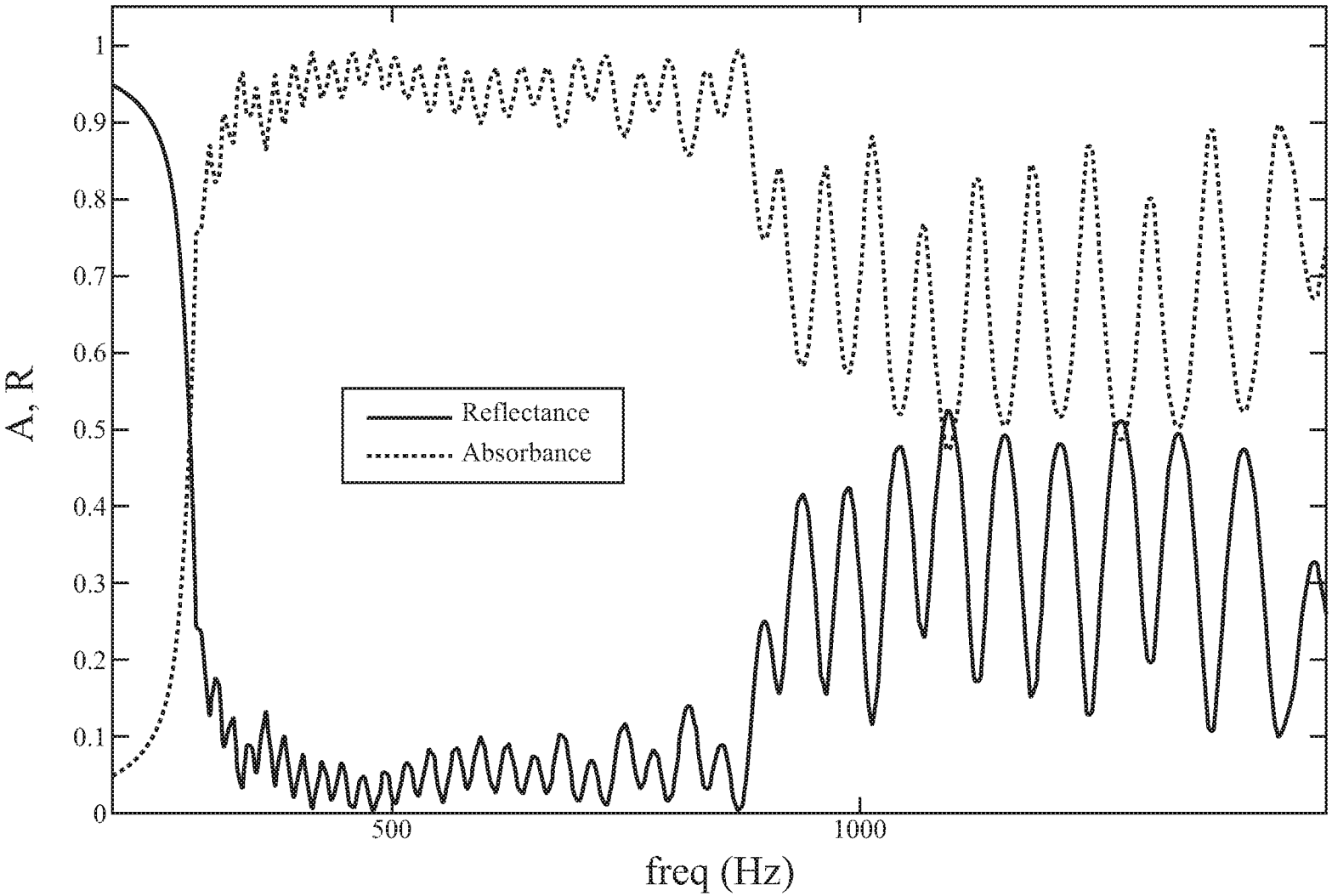
FIG. 13 is a simulated graph representing acoustic absorbance and reflection as a function of frequency for an acoustic panel with tubular quarter-wavelength resonators of different lengths being periodically arranged.

FIG. 12 is a simulated graph representing acoustic absorbance and reflection (ranging from zero (0) to 1) as a function of frequency for an acoustic panel with tubular quarter-wavelength resonators of the same length being shaped, structurally rigid, and periodically arranged. FIG. 13 is a simulated graph representing acoustic absorbance and reflection (ranging from zero (0) to 1) as a function of frequency for an acoustic panel with tubular quarter-wavelength resonators of different lengths being shaped, structurally rigid, and periodically arranged. In the simulated examples of FIGS. 12-13, the acoustic absorption is defined as a ratio of absorbed acoustic power to incident power, with A=1 as being the highest value. In FIG. 12, almost perfect acoustic absorption, with A being near 1, is provided at a resonance frequency of about 800 Hz. In FIG. 13, the absorber shows a multiband absorption with a high absorption, for example, greater than 0.9, extending between frequencies of from about 300 Hz to about 800 Hz.

The preceding description is merely illustrative in nature and is in no way intended to limit the disclosure, its application, or uses. As used herein, the phrase at least one of A, B, and C should be construed to mean a logical (A or B or C), using a non-exclusive logical "or." It should be understood that the various steps within a method may be executed in different order without altering the principles of the present disclosure. Disclosure of ranges includes disclosure of all ranges and subdivided ranges within the entire range.

The headings (such as "Background" and "Summary") and sub-headings used herein are intended only for general organization of topics within the present disclosure, and are not intended to limit the disclosure of the technology or any aspect thereof. The recitation of multiple embodiments having stated features is not intended to exclude other embodiments having additional features, or other embodiments incorporating different combinations of the stated features.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an embodiment can or may comprise certain elements or features does not exclude other embodiments of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with an embodiment or particular system is included in at least one embodiment or aspect. The appearances of the phrase "in one aspect" (or variations thereof) are not necessarily referring to the same aspect or embodiment. It should be also understood that the various method steps discussed herein do not have to be carried out in the same order as depicted, and not each method step is required in each aspect or embodiment.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations should not be regarded as a departure from the disclosure, and all such modifications are intended to be included within the scope of the disclosure.

What is claimed is:

1. A shaped acoustic absorber assembly with broadband absorption, the shaped acoustic absorber assembly comprising:

an acoustic panel defining a plurality of apertures; and a plurality of tubular quarter-wavelength resonators of variable lengths respectively aligned with the plurality of apertures and coupled to the acoustic panel, each tubular quarter-wavelength resonator comprising:

at least one perimeter boundary wall extending in a longitudinal length direction and defining a chamber cavity having a chamber volume;

a first end defining an opening aligned with one of the plurality of apertures and coupled to the acoustic panel, the opening being configured to provide fluid communication between the chamber cavity and an external environment; and a second end, opposite the first end, the second end being sealed and configured for being located adjacent to a target substrate, the plurality of tubular quarter-wavelength resonators being shaped to coordinate with or substantially match a three-dimensional geometry and dimensions of at least one surface of the target substrate, a length of the at least one perimeter boundary wall of one of the plurality of tubular quarter-wavelength resonators being different than a length of one or more of the other tubular quarter-wavelength resonators.

2. The shaped acoustic absorber assembly according to claim 1, wherein each perimeter boundary wall comprises a flexible material that is preserved in a structurally rigid configuration after being shaped.

3. The shaped acoustic absorber assembly according to claim 2, wherein the flexible material comprises at least one of an ultra-violet (UV) curable composition, a UV curable coating, a thermally curable composition, and a thermally curable coating.

4. The shaped acoustic absorber assembly according to claim 1, wherein at least two tubular quarter-wavelength resonators are arranged together to collectively form a shape that coordinates with a geometry and dimensions of the target substrate.

5. The shaped acoustic absorber assembly according to claim 4, wherein at least two tubular quarter-wavelength resonators are coupled together with a fastening mechanism to retain the shape.

6. The shaped acoustic absorber assembly according to claim 1, wherein each tubular quarter-wavelength resonator is a hollow tube independently coupled to the acoustic panel.

7. The shaped acoustic absorber assembly according to claim 1, wherein each second end defines an opening, and each tubular quarter-wavelength resonator further comprises an end cap disposed within the opening of the second end to provide a seal.

8. The shaped acoustic absorber assembly according to claim 1, wherein a cross-sectional shape of the perimeter boundary wall of the tubular quarter-wavelength resonators in the longitudinal length direction is one of a circle, a triangle, and a rectangle.

9. The shaped acoustic absorber assembly according to claim 1, wherein each tubular quarter-wavelength resonator exhibits a resonance frequency, f, according to the relationship:

$$f = \frac{c}{4L}$$

where c is the speed of sound of fluid in the chamber cavity, and L is a length dimension of the tubular quarter-wavelength resonator.

10. The shaped acoustic absorber assembly according to claim 1, wherein the acoustic panel comprises a flexible substrate.

11. The shaped acoustic absorber assembly according to claim 1, wherein the acoustic panel comprises a rigid substrate.

12. The shaped acoustic absorber assembly according to claim 1, wherein a center to center periodic distance, P, of each of tubular quarter-wavelength resonator is the same for the plurality of tubular quarter-wavelength resonators.

13. The shaped acoustic absorber assembly according to claim 1, comprising a plurality of acoustic panels arranged in a periodic array, wherein each acoustic panel comprises a plurality of tubular quarter-wavelength resonators shaped to coordinate with a geometry and dimensions of the target substrate.

14. A shaped acoustic absorber system with broadband absorption, the shaped acoustic absorber system comprising:

a target substrate;

a plurality of acoustic panels arranged in a periodic array, each acoustic panel comprising a plurality of tubular quarter-wavelength resonators of variable lengths coupled to a plurality of apertures defined in a surface of the acoustic panel, each tubular quarter-wavelength resonator comprising:

at least one perimeter boundary wall extending in a longitudinal length direction and defining a chamber cavity having a chamber volume, the perimeter boundary wall comprising a flexible material configured to be shaped to coordinate with or substantially match a three-dimensional geometry and dimensions of at least one surface of the target substrate and subsequently be preserved in a structurally rigid configuration, a length of the at least one perimeter boundary wall of one of the plurality of tubular quarter-wavelength resonators being different than a length of one or more of the other tubular quarter-wavelength resonators;

a first end defining an opening aligned with one of the plurality of apertures and coupled to the acoustic panel, the opening being configured to provide fluid communication between the chamber cavity and an external environment;

a second end, opposite the first end; and an end cap disposed in the second end and cooperating with the perimeter boundary wall to define the chamber cavity.

15. A method for making a shaped acoustic absorber assembly with broadband absorption, the method comprising:

providing an acoustic panel with a plurality of flexible tubular quarter-wavelength resonators of variable lengths coupled adjacent to a plurality of apertures defined in the acoustic panel, each quarter-wavelength resonator comprising:

at least one perimeter boundary wall extending in a longitudinal length direction and defining a chamber cavity having a chamber volume;

a first end defining an opening aligned with one of the plurality of apertures and coupled to the acoustic panel, the opening being configured to provide fluid communication between the chamber cavity and an external environment; and a second end, opposite the first end, the second end being sealed and configured for being located adjacent a target substrate;

shaping the plurality of flexible tubular quarter-wavelength resonators to coordinate with or substantially match a three-dimensional geometry and dimensions of at least one surface of the target substrate intended to be located in proximity with the acoustic panel, a length of the at least one perimeter boundary wall of one of the plurality of flexible tubular quarter-wavelength resonators being different than a length of one or more of the other flexible tubular quarter-wavelength resonators; and preserving a shape of the flexible tubular quarter-wavelength resonators in a structurally rigid configuration.

16. The method according to claim 15, wherein the flexible tubular quarter-wavelength resonators comprise at least one of a curable composition and a curable coating, and wherein the step of preserving the shape of the flexible tubular quarter-wavelength resonators comprises curing the curable composition or the curable coating with UV radiation or heat.

17. The method according to claim 15, wherein the step of preserving the shape of the flexible tubular quarter-wavelength resonator comprises mechanically fastening a plurality of flexible tubular quarter-wavelength resonators to one another.

18. The method according to claim 15, wherein:

the step of shaping the plurality of flexible tubular quarter-wavelength resonators comprises aligning the flexible tubular quarter-wavelength resonators in a mold having a shape commensurate with the geometry and dimensions of the target substrate; and the step of preserving the shape of the flexible tubular quarter-wavelength resonators comprises: filling a free space between the flexible tubular quarter-wavelength resonators with a curable liquid solution; and curing the curable liquid solution.

19. The method according to claim 15, wherein the step of preserving the shape of the flexible tubular quarter-wavelength resonators comprises arranging the flexible tubular quarter-wavelength resonators adjacent to one another and forming a densely packed arrangement.

20. The method according to claim 15, wherein the step of preserving the shape of the flexible tubular quarter-wavelength resonators comprises applying a spray coating to at least a portion of the flexible tubular quarter-wavelength resonators using a thermal spraying technique.

* * * * *